US006390953B1

(12) United States Patent
Maresh et al.

(10) Patent No.: US 6,390,953 B1
(45) Date of Patent: May 21, 2002

(54) EXERCISE METHODS AND APPARATUS

(76) Inventors: Joseph D. Maresh, P.O. Box 645, West Linn, OR (US) 97068-0645; Kenneth W. Stearns, P.O. Box 55912, Houston, TX (US) 77055

( * ) Notice: Subject to any disclaimer, the term of this patent is extended or adjusted under 35 U.S.C. 154(b) by 0 days.

(21) Appl. No.: 09/604,332

(22) Filed: Jun. 27, 2000

(51) Int. Cl.[7] ..... A63B 69/16; A63B 22/04
(52) U.S. Cl. ..... 482/52; 482/51; 482/70
(58) Field of Search ..... 482/51, 52, 53, 482/57, 70, 79, 80

(56) References Cited

U.S. PATENT DOCUMENTS 5,743,834 A * 4/1998 Rodgers, Jr. ..... 482/57
6,007,462 A * 12/1999 Chen ..... 482/57
6,024,676 A * 2/2000 Eschenbach ..... 482/51
6,045,487 A * 4/2000 Miller ..... 482/52
6,196,948 B1 * 3/2001 Stearns et al. ..... 482/52

* cited by examiner

*Primary Examiner*—Stephen R. Crow

(57) ABSTRACT

An exercise apparatus includes a crank rotatably mounted on a frame, and a connector link rotatably interconnected between the crank and a foot supporting link. The entire connector link is constrained to pivot about a fixed point while a portion of the connector link rotates together with the crank. The location of the fixed point is selectively adjustable. A discrete portion of the foot supporting link is constrained to move in a reciprocal path relative to the frame. The reciprocal path is also selectively adjustable.

13 Claims, 4 Drawing Sheets

EXERCISE METHODS AND APPARATUS

FIELD OF THE INVENTION

The present invention relates to exercise methods and apparatus and more particularly, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and still other machines allow a person to skate and/or stride in place. Yet another type of exercise equipment has been designed to facilitate relatively more complicated exercise motions and/or to better simulate real life activity. Such equipment typically uses a linkage assembly to convert a relatively simple motion, such as circular, into a relatively more complex motion, such as elliptical. Despite many such advances in the art, room for improvement remains.

SUMMARY OF THE INVENTION

The present invention may be seen to provide a novel linkage assembly and corresponding exercise apparatus suitable for linking circular motion to relatively more complex, generally elliptical motion. On a preferred embodiment, for example, left and right connector links are rotatably interconnected between respective cranks and intermediate portions of respective foot supports, and are constrained to pivot in their entirety about a common pivot axis on a floor engaging frame. The foot supports have first ends pivotally connected to respective rocker links which pivot about a common rocker axis on the frame. Opposite, second ends of the foot supporting links are sized and configured to support a person's feet. The arrangement is such that the person's feet move through elliptical paths which may be adjusted by selectively relocating the pivot axis and/or the rocker axis. Additional features of the present invention may become more apparent from the more detailed description set forth below.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
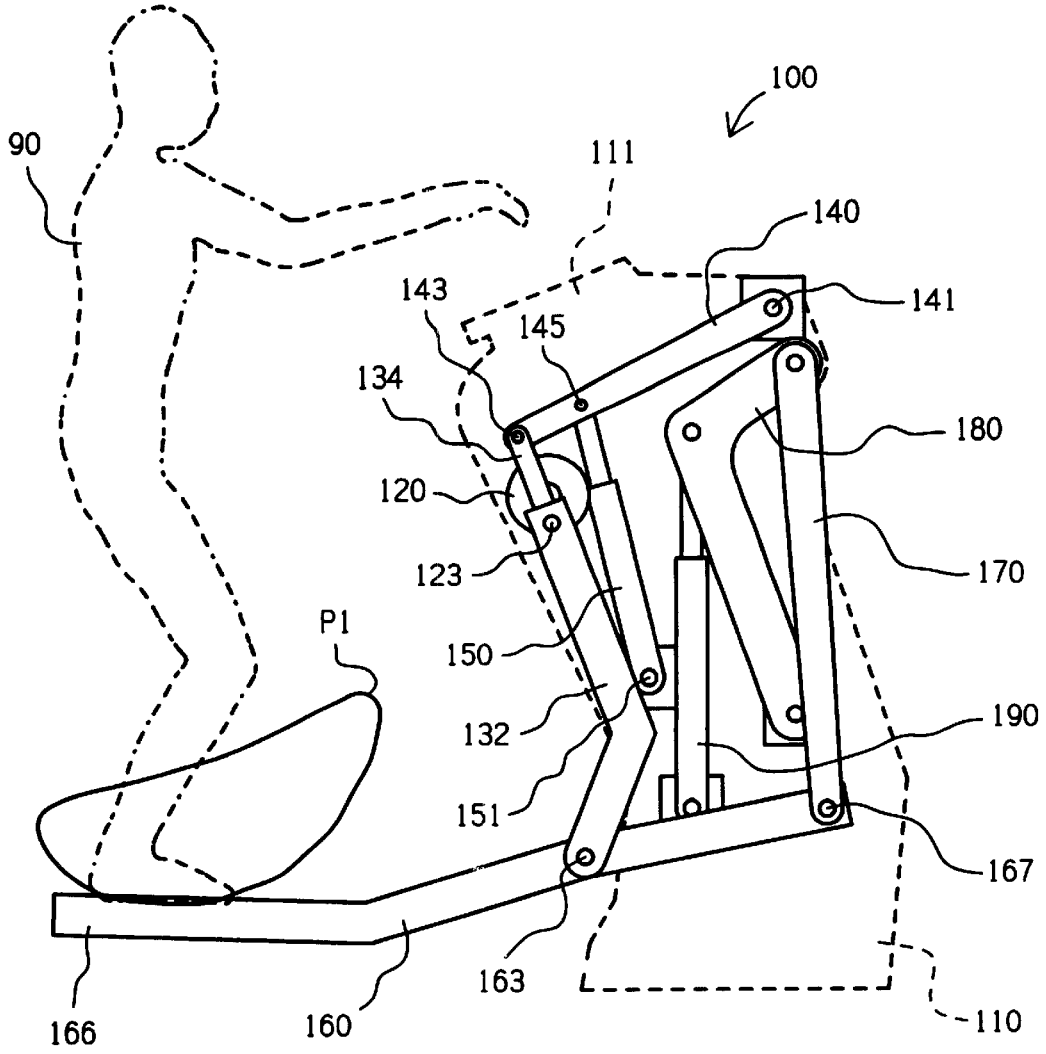
FIG. 1 is a side view of an exercise apparatus constructed according to the principles of the present invention and configured for foot movement through a first path.
Figure 2:
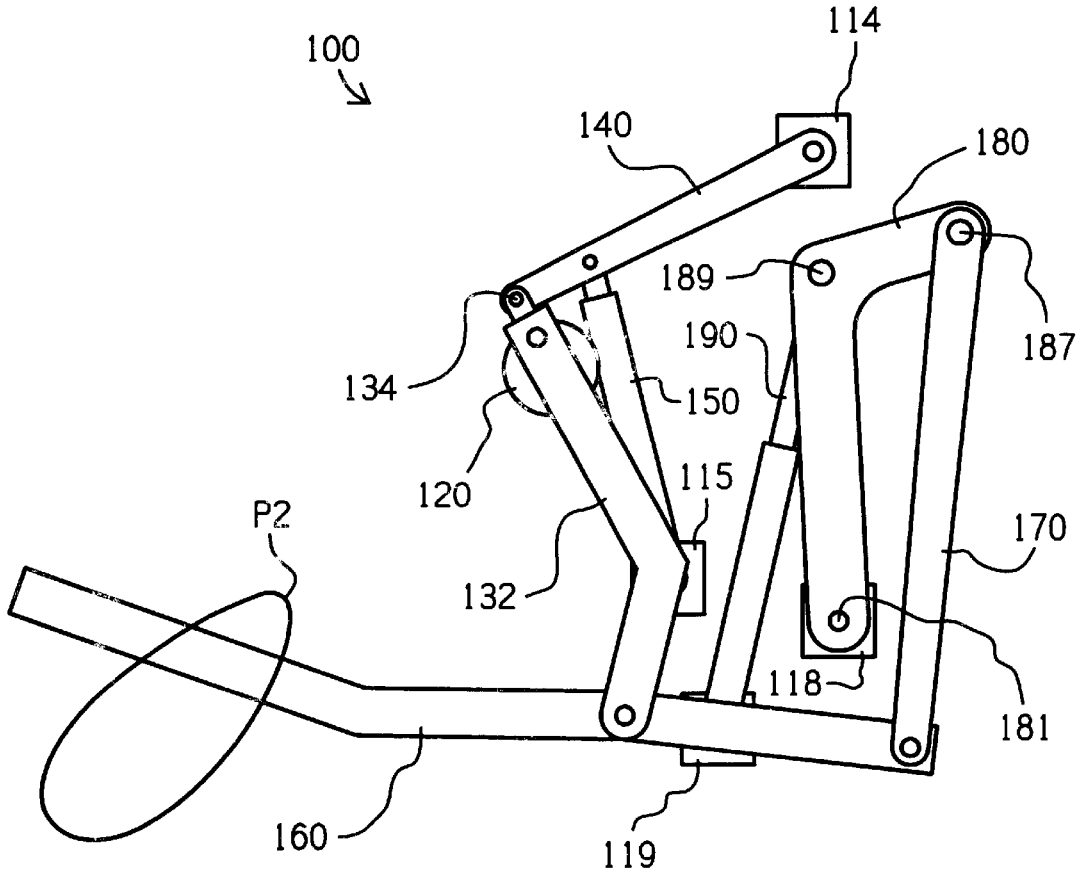
FIG. 2 is a side view of the exercise apparatus of FIG. 1 configured for foot movement through a second path.
Figure 3:
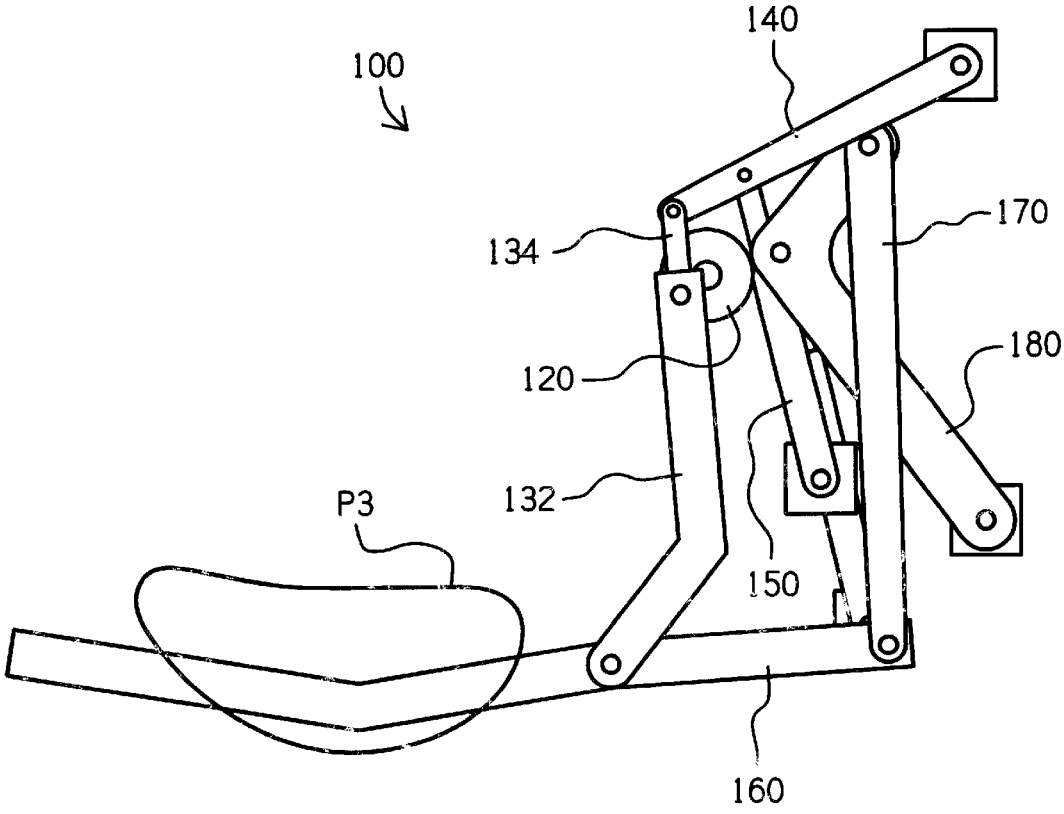
FIG. 3 is a side view of the exercise apparatus of FIG. 1 configured for foot movement through a third path.
Figure 4:
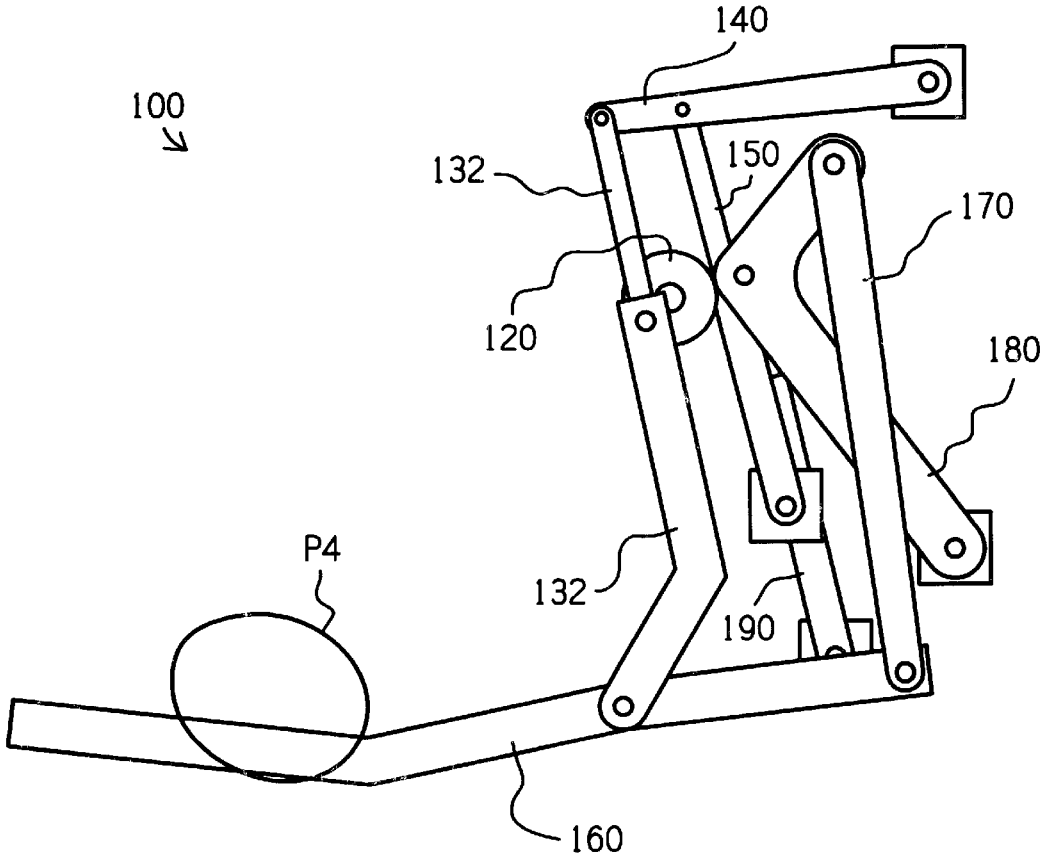
FIG. 4 is a side view of the exercise apparatus of FIG. 1 configured for foot movement through a fourth path.

An exercise apparatus constructed according to the principles of the present invention is designated as 100 in FIGS. 1–4. The exercise apparatus 100 generally includes a linkage assembly which moves relative to a frame 110 in a manner that links rotation of left and right cranks 120 to generally elliptical motion of left and right foot supporting members 160. The term "elliptical motion" is intended in a broad sense to describe a closed path of motion having a relatively longer first axis and a relatively shorter second axis (which is perpendicular to the first axis).

The frame 110 is designed to rest upon a floor surface and includes frame portions or members 114, 115, 118, and 119. A user interface 111 is mounted on an upper portion of the frame 110 and within reach of a person 90 standing on the foot supporting members 160. The interface 111 may be configured to perform a variety of functions, including (1) displaying information to the user, including (a) exercise parameters and/or programs, (b) the current parameters and/or currently selected program, (c) the current time, (d) the elapsed exercise time, (e) the current speed of exercise, (f) the average speed of exercise, (g) the number of calories burned during exercise, (h) the simulated distance traveled during exercise, and/or (i) material transmitted over the internet; (2) allowing the user to (a) select or change the information being viewed, (b) select or change an exercise program, (c) adjust the resistance to exercise, (d) adjust the range of exercise motion, and/or (e) adjust the orientation of exercise motion.

The apparatus 100 is generally symmetrical about a vertical plane extending lengthwise through the frame 110, the only exceptions being the members interconnected between opposite side parts and the relative orientation of certain parts on opposite sides of the linkage assembly. In FIGS. 1–4, only the "right-hand" components are shown, with the understanding that similar "left-hand" components are one hundred and eighty degrees out of phase with the depicted components.

On each side of the linkage assembly, a crank 120 is rotatably mounted on the frame 110. An upper end of a first telescoping member 132 is rotatably connected to the crank 120 (at connection point 123), and a lower end of the first telescoping member 132 is pivotally connected to an intermediate portion of the foot supporting member 160 (at connection point 163). A lower end of a second telescoping member 134 is inserted in the upper end of the first telescoping member 132 and movable in telescoping fashion relative thereto. Rollers may be rotatably mounted on one or both of the telescoping members 132 and 134 to facilitate the telescoping motion. An opposite, upper end of the second telescoping member 134 is pivotally connected to a first end of a first support link 140 (at connection point 143). An opposite, second end of the first support link 140 is pivotally connected to the frame member 114 (at connection point 141). An intermediate portion of the first support link 140 is pivotally connected to a rod end of an actuator 150 (at connection point 145). An opposite, cylinder end of the actuator 150 is pivotally connected to the frame member 115 (at connection point 151). Only one actuator 150 is provided to adjust both the right and left first support links 140.

The foot supporting member 160 has a cantilevered, rearward end 166 which is sized and configured to support a person's foot. An opposite, forward end of the foot supporting member 160 is pivotally connected to a lower end of a rocker link 170 (at connection point 167). An opposite, upper end of the rocker link 170 is pivotally connected to a second support link 180 (at connection point 187). The second support link 180 is pivotally connected to the frame member 118 (at connection point 181). The second support link 180 is also pivotally connected to a rod end of an actuator 190 (at connection point 189). An opposite, cylinder end of the actuator 190 is pivotally connected to the frame member 119 (at connection point 191). Only one actuator 190 is provided to adjust both the right and left second support links 180.

To use the apparatus 100, a person stands with a respective foot on each of the foot supports 166 and begins moving his or her feet in striding fashion. The linkage assembly constrains the person's feet to move through elliptical paths while the cranks 120 rotate relative to the frame 110. The elliptical paths are selectively adjustable by means of the actuators 150 and 190, which may be operatively connected to the user interface 111 and responsive to control signals generated by a control program, the user, or another external influence. FIGS. 1–4 show the apparatus 100 configured for four different foot paths P1–P4, which are a function of the locations of the connection points 143 and 187 relative to the frame 110. Stationary handles and/or movable handles may be mounted on the frame 110 and within reach of the person 90 standing on the foot supports 166. The movable handles may be linked to the foot supports 166 and/or independently operable. Resistance to arm movement and/or leg movement may be provided in various known manners, and operatively connected to the user interface, as well. A flywheel may be linked to the cranks 120 to add inertia to the linkage assembly.

The apparatus 100 may be modified in a number of ways without departing from the scope of the present invention. For example, the rocker links 170 could be replaced by rollers mounted on the forward ends of the foot supporting links 160 and disposed within a generally horizontal race on the frame. Also, the telescoping links 134 could be replaced by rollers mounted on the ends of the first support links 140 and disposed within races on longer versions of the other telescoping links 132. Additionally, one or both of the actuators 150 and 190 could be paired with an aligned race on the frame, rather than a pivoting support link, for purposes of relocating a respective connection point 143 or 187. The race for the connection point 143 is preferably inclined rearwardly upward at an angle between thirty and forty-five degrees from vertical. The race for the connection point 187 is preferably inclined forwardly upward at an angle between fifteen and thirty degrees from horizontal.

Those skilled in the art will recognize that the present invention may also described in terms of methods (with reference to the foregoing embodiment 100, for example). One such method involves linking rotation of a crank to generally elliptical movement of a foot supporting member. The method includes the steps of rotatably mounting a crank on a frame; rotatably connecting a link to the crank; constraining the link to pivot in its entirety about a pivot axis; rotatably connecting the link to an intermediate portion of a foot supporting member; and constraining an end of the foot supporting member to move in reciprocating fashion relative to the frame. The method may further include the step of changing the location of one or more of the connection points between the linkage assembly and the frame, in order to change the path traveled by the foot supporting member.

The present invention is not limited to the preferred embodiment disclosed herein, and persons skilled in the art are likely to recognize additional embodiments, modifications, and/or features which nonetheless fall within the scope of the present invention. For example, modifications may be made to the size, configuration, and/or arrangement of the linkage assembly components as a matter of design choice, and/or portions thereof may be replaced with mechanical equivalents. Recognizing that the foregoing description sets forth only some of the possible modifications and variations, the scope of the present invention is to be limited only to the extent of the claims which follow.

What is claimed is:

1. A manually operated exercise apparatus, comprising:

a frame designed to rest upon a floor surface;

a left link and a right link disposed on respective sides of said frame;

a left crank and a right crank disposed on respective sides of said frame and rotatable about a common crank axis relative to said base, wherein each said crank is rotatably connected to a respective link;

a left constraining means and a right constraining means disposed on respective sides of said frame, each said constraining means for constraining a respective link to remain aligned with a common pivot axis as each said crank rotates;

a left foot support and a right foot support disposed on respective sides of said frame, wherein each said foot support has an intermediate portion pivotally connected to a respective link, and each said foot support has a rearward portion which is sized and configured to support a person's foot; and a left orienting means and a right orienting means disposed on respective sides of said frame, each said orienting means for maintaining a respective foot support in a generally horizontal orientation while moving through a generally elliptical path relative to said frame as each said crank rotates.

2. The exercise apparatus of claim 1, wherein each said constraining means comprises a telescoping member pivotally connected to said frame and connected in telescoping fashion to a respective link.

3. The exercise apparatus of claim 2, wherein each said orienting means includes a rocker link pivotally interconnected between said frame and a respective foot support.

4. The exercise apparatus of claim 2, wherein each said telescoping member pivots about a common pivot axis, and said pivot axis is selectively adjustable relative to said frame.

5. The exercise apparatus of claim 4, wherein each said orienting means includes a rocker link pivotally interconnected between said frame and a respective foot support.

6. The exercise apparatus of claim 5, wherein each said rocker link pivots about a common rocker axis, and said rocker axis is selectively adjustable relative to said frame.

7. The exercise apparatus of claim 1, wherein each said orienting means includes a rocker link pivotally interconnected between said frame and a respective foot support.

8. The exercise apparatus of claim 7, wherein each said rocker link pivots about a common rocker axis, and said rocker axis is selectively adjustable relative to said frame.

9. The exercise apparatus of claim 1, further comprising a means for adjusting an angle of inclination defined between the floor surface and a major axis of the generally elliptical path.

10. The exercise apparatus of claim 9, further comprising a means for adjusting the length of the major axis.

11. A manually operated exercise apparatus, comprising:

a frame designed to rest upon a floor surface;

a left crank and a right crank disposed on respective sides of said frame and rotatable about a common crank axis relative to said frame;

a left link and a right link disposed on respective sides of said base, wherein each said link is rotatably connected to a respective crank, and each said link is movably connected to said frame in such a manner that each said link is constrained to pivot in its entirety about a common pivot point relative to said frame;

a left foot support and a right foot support disposed on respective sides of said frame, wherein each said foot support is connected to a respective link, and each said foot support moves through a generally elliptical path relative to said frame as each said crank rotates; and a left rocker link and a right rocker link disposed on respective sides of said frame and pivotally interconnected between said frame and a respective foot support.

12. The exercise apparatus of claim 11, wherein said common pivot axis is selectively movable relative to said frame for purposes of adjusting said generally elliptical path.

13. The exercise apparatus of claim 11, wherein each said rocker link pivots about a common rocker axis which is selectively movable relative to said frame for purposes of adjusting said generally elliptical path.

* * * * *